United States Patent [19]

Igel et al.

[11] Patent Number: 4,823,543

[45] Date of Patent: Apr. 25, 1989

[54] APPARATUS FOR THE SPINNING OF YARN

[75] Inventors: Wolfgang Igel, Ebersbach; Helmut Nickolay, Göppingen; Karl-Heinz Mack, Weilheim; Werner Meissner, Hattenhofen, all of Fed. Rep. of Germany

[73] Assignee: Zinser Textilmaschinen GmbH, Ebersbach, Fed. Rep. of Germany

[21] Appl. No.: 69,479

[22] Filed: Jul. 2, 1987

[30] Foreign Application Priority Data

Jul. 3, 1986 [DE] Fed. Rep. of Germany ..... 3622406
Oct. 29, 1986 [DE] Fed. Rep. of Germany ..... 3636779

[51] Int. Cl.[4] ..... D01H 13/16

[52] U.S. Cl. ..... 57/80; 57/83; 57/84

[58] Field of Search ..... 57/78–83, 57/264

[56] References Cited

U.S. PATENT DOCUMENTS 2,599,256 6/1952 Hartley et al. ..... 57/80 X
4,375,149 3/1983 Hartsmannsgruber ..... 57/80 X
4,418,522 12/1983 Harrop et al. ..... 57/80
4,630,434 12/1986 Hartsmanngruber et al. ..... 57/80 X

*Primary Examiner*—Donald Watkins
*Attorney, Agent, or Firm*—Herbert Dubno

[57] ABSTRACT

Apparatus for spinning yarn from roving including a spinning frame with spinning units arranged thereon. The roving to be drawn is fed from a common double-roving bobbin to each of two neighboring spinning units, further referred to as spinning units pair. At least one stopping device is assigned to each of the spinning units of the spinning units pair, to stop and release again the roving feed to the two drawing frames of the respective spinning units pair. The purpose of the stopping device is to reduce the loss of roving and to avoid the danger of yarn lapping on the drawing rollers. The stopping device can be actuated by each of two yarn break sensors of the spinning units pair for the simultaneous arrest of the roving. In a second embodiment a yarn-setting carriage is provided on the spinning frame to correct a yarn break, such correction occuring only when all correction hindering conditions are absent.

14 Claims, 2 Drawing Sheets

APPARATUS FOR THE SPINNING OF YARN

FIELD OF THE INVENTION

The invention relates to an apparatus for the spinning of yarn.

BACKGROUND OF THE INVENTION

Spinning machines are known wherein the roving is wound around so-called double-roving bobbins. On each of these double-roving bobbins, two rovings, preferably of combed wool, but also optionally other fibers or mixed fibers, are wound in parallel to each other. Slivers from both of these rovings which together form a fiber strand have to be drawn from the double-roving bobbin at the same time.

The spinning machine can preferably be a ring spinning frame, but optionally also a spinning machine for yarns having drawing mechanisms, such as a cap spinning frame, or a twine spinning machine or the like.

In ring spinning frames whose rovings are not fed by double-roving bobbins, but wherein each spinning unit receives the roving from its own roving bobbin assigned only to this spinning unit, it is known to provide a separate stopping device. After a yarn break this device stops the feeding of the roving. Thereby unnecessary waste of roving is prevented and the danger of roving laps on the drawing rollers is avoided up to the moment the yarn break is fixed. In the case of spinning frames operating with double-roving bobbins, the known stopping devices are not applicable.

It is therefore an object of the invention to create a spinning frame of the afore-mentioned kind, wherein it is also possible to prevent or at least minimize the danger of roving laps on the drawing rollers and to reduce the waste of roving during yarn breaks.

SUMMARY OF THE INVENTION

This object is attained with an apparatus for spinning of yarns from rovings that comprises a spinning frame, a plurality of spinning units arranbged on the frame, a plurality of drawing means, a yarn break sensor, and stopping means. Each of two neighboring spinning units form a spinning units pair and are supplied with the roving to be drawn from a common double-roving bobbin. The plurality of drawing means for drawing the rovings are also arranged on the frame with one of the drawing means associated with each of the spinning units. A yarn break sensor is also assigned to each of the spinning units. Stopping means for arresting and restarting feeding of the rovings to the drawing means are provided where one of the stopping means is assigned to each of the spinning units pair. Each stopping means also includes a pair of shells which press both rovings against a pair of upper rollers arresting those rollers.

A second embodiment of the present invention provides an apparatus which includes a spinning frame, a plurality of spinning units arranged on the frame, a plurality of drawing means, a yarn-setting carriage, and a detecting means. The yarn-setting carriage automatically corrects for yarn breaks. Detecting means are positioned on either the yarn-setting carriage, spinning frame or both. This detecting means at the start of a first yarn-break correction attempt checks whether at each of the two spinning units there is present one or more prerequisites to achieve a successful yarn-breaking correction. If the checking indicates that the prerequisites are not met, the detecting means triggers the carriage to continued traveling without attempting this correction.

With the apparatus according to the invention first embodiment, it is ensured that in the case of yarn break, the feeding of the roving coming from the respective double-roving bobbin is completely stopped, i.e. at both spinning units of the respective spinning-unit pair. Thereby, unnecessary consumption of roving is avoided. There is also prevented the danger of extensive fiber-lap formations on the drawing rollers during yarn breakage. As a consequence, no longer is there danger of damage to the drawing frame or the like due to extensive fiber lapping.

With the apparatus according to the invention second embodiment, the consumption of roving as well as danger of fiber-lap formations on the drawing rollers can be reduced. Thus, since when at one of the two spinning units or at both spinning units of the spinning units pair a yarn break cannot be fixed through the yarn setter due to limits imposed by the detecting and/or checking means, attempts to fix the yarn breakage are interrupted at both spinning units. Otherwise, it could happen, for instance, that a simultaneous yarn break at both spinning units, as always occurs in the first and occasionally in the second embodiment, the yarn setter could manage to repair the yarn break at one of the spinning units of the respective spinning units pair but not at the other spinning unit. Here the system leads to unnecessary roving consumption and to the danger of lap formations on the drawing rollers of the spinning unit wherein the yarn break has not been fixed.

Also, unnecessary time waste of the yarn setter is avoided, which increases productivity.

Preferably, the apparatus of the second embodiment, can include certain aspects of the first embodiment such as a yarn break sensor and stopping means. However, it is to be noted that both the first and second embodiments by themselves include improvements presenting a considerable advantage.

According to the first embodiment of this invention, a yarn break causes through stoppage of the respective roving, a "sequel yarn break" to simultaneously occur in the other spinning unit of the respective spinning unit pair. This disadvantage of the respective secondary yarn break is, however, largely outweighed by the advantages of low roving consumption and by the prevention of the danger of fiber lapping at the drawing rollers, in the wake of a yarn break. The arresting means assigned to the individual spinning units pair can consist of a single common stopping device for both spinning units or of two separate stopping devices for the two spinning units. The two separate stopping devices can each be started in common by a yarn break signal coming from either one of the two yarn break sensors of the respective spinning units pair. Alternately, the common stopping device is built in such a manner that it has at both spinning units of the roving commonly arresting stopping elements or mechanically coupled stopping elements.

The separate stopping devices can have the same or a similar construction as known ring spinning frames (wherein each stopping device assigned to a spinning unit is individually actuatable) without being coupled with the neighboring stopping devices. A difference over the known art resulting from the present arrangement is that the respective separate stopping means assigned to a respective spinning units pair are each commonly actuatable, either through mechanical coupling or through actuation via a single control element assigned to each spinning unit, whereby these two control elements are each commonly actuatable. Such a control element can, for instance, have an electromagnet. Of course, also other forms of stopping means assigned to a spinning units pair are possible, since all that is needed is a means for stopping, preferably simultaneously, both rovings coming from a sliver bobbin. However, it can optionally be provided that the stopping means at the two spinning units of the spinning units pair are actuated shortly one after the other for the stoppage of the roving. In the apparatus accordiang to the first embodiment, both yarn breaks can be fixed either manually or by means of an automatically operating yarn setter. Because of the sequel yarn break in the other spinning unit of the respective spinning units pair, the fixing of a yarn break in a spinning unit presumes that the stopping devices which prior to the fixing of the yarn break have been deactivated i.e. have been set in an inactive state, are not allowed yet to be reactivated. For this purpose, manual or automatic switching means can be provided. For instance, they can consist of a manually actuatable electric switch, which is switched off by an operator prior to the start of the fixing of the two yarn breaks at a spinning units pair and thereby disconnecting the two yarn break sensors of this spinning units pair from the thereto assigned stopping device. The operator can now eliminate the two yarn breaks one after the other. He then turns the switch on, so that when a new yarn break occurs at one of these spinning units, the stopping means of the respective spinning units pair can be again actuated by each of the two yarn break sensors, to stop the roving. Alternately, here can be provided an automatic switching means which can, by sensing of a yarn break through any one of the two yarn break sensors or through the stopping means as a result of their respective actuation, effect disconnection of the two yarn break sensors from the respective stopping means. It can also be provided that, when a yarn setter serves for the automatic fixing of yarn breaks, this yarn setter after fixing the two yarn breaks, in anyone of the spinning unit pair, perform or start the reactivation of the respective switching means at that spinning units pair, so that this way also only after the two yarn breaks have been fixed, the sensors can reactivate the stopping means, but not during the repair of the yarn breaks.

It is also possible to provide signalling means which send switch-on signals to the switching means during the operation of the spinning machine at predetermined intervals, preferably periodically, namely to all these switching means on the respective spinning machine, to make sure that if such switching means assigned to a spinning unit pair are not switched on again for any reason, e.g. because the operator forgot to do so, the automatic reactivation of these switching means will still take place. For instance, such switch-on signals can be repeated at time intervals of several minutes.

The apparatus according to the second embodiment always has a yarn-setting carriage. Checking-and/or sensing means can be particularly talored to sense whether the roving can be supplied to the two spinning units of the spinning units pair, namely to their drawing frames and/or whether in ring spinning frames at both spinning units travelers are available on the spinning rings and/or whether the predetermined drawing rollers or drawing frames are free of yarn laps and/or whether the respective spinning units pair is registered as "dead".

It is of particular advantage in the case of a yarn setter to provide means which would set off an indication that the respective spinning unit or unit pair be registered as dead when the setter has not succeeded to repair the yarn breaks after a predetermined number of attempts. Moreover the yarn setter must be further provided with means to make sure that the setter recognizes the spinning units pairs registered as "dead" and that it does not attempt to repair the yarn breaks at each of these spinning units pairs. This can be so arranged that the yarn setter stops for a short while at the respective "dead" spinning units pair to check whether it is registered as "dead". However, it is better to perform this checking operation with the running yarn setter and not have to stop it at all at such spinning unit pairs.

Also it can preferably be arranged that when the yarn-setting carriage unsuccessfully abandons its effort to fix a yarn break at the first unit of a spinning units pair and thereby triggers the registration as "dead" of this spinning units pair, it does not hereafter try to fix a yarn break at the other spinning unit of this spinning units pair, but on the contrary activates therein the slubbing-stopping means, in order to interrupt the roving feed at that spinning units pair.

The registration as "dead" of a spinning unit or a spinning units pair, can be cancelled by an operator, after he has corrected the disturbance.

BRIEF DESCRIPTION OF THE DRAWING

In the drawing, an embodiment example of the invention is represented. It shows.

DETAILED DESCRIPTION

Figure 1:
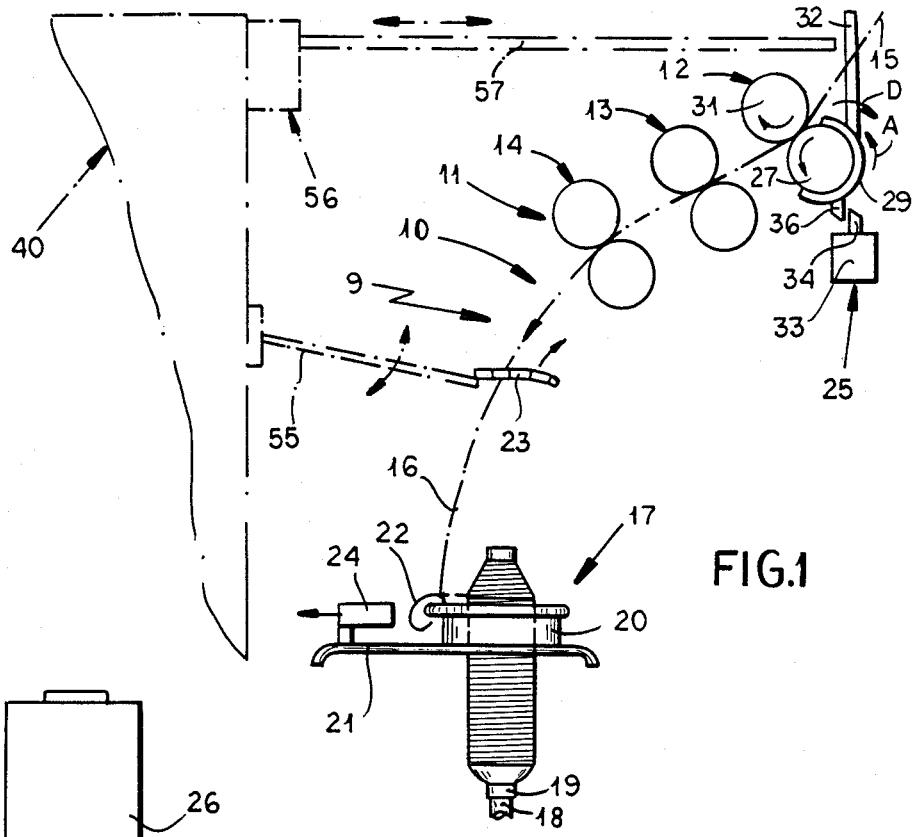
FIG. 1 a schematic side view of a spinning unit of a ring spinning frame.
Figure 2:
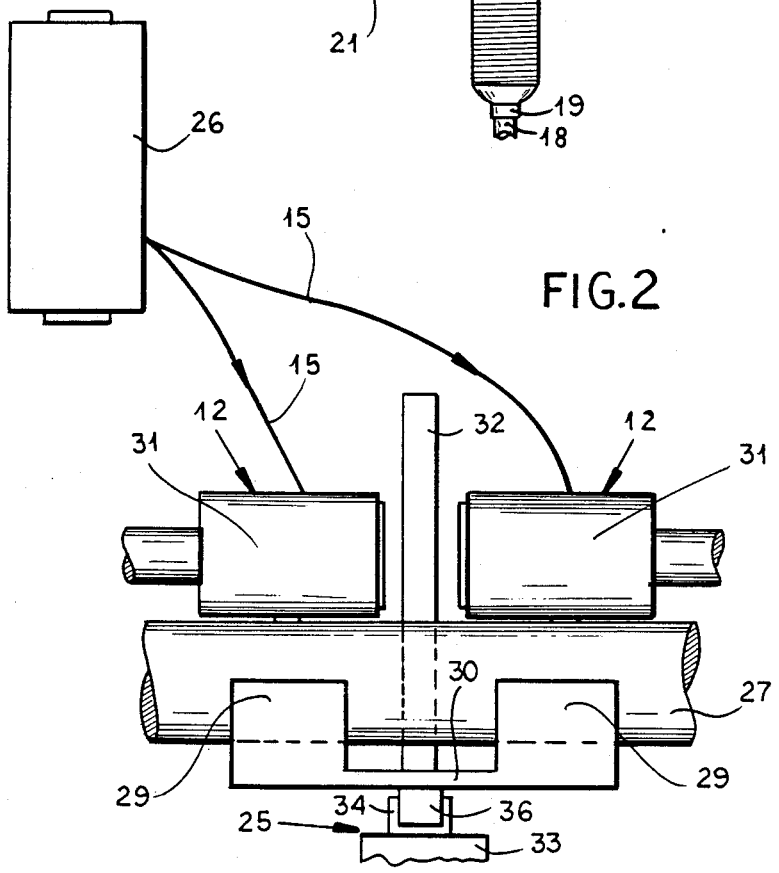
FIG. 2 a frontal view of the feed rollers of a spinning units pair with a device for stopping the roving feed, FIG. 3 a detailed schematic representation of several neighboring spinning units of the ring spinning frame according to FIG. 1 and of a yarn-setting carriage traveling along these spinning units for the correction of yarn breaks.
Figure 3:
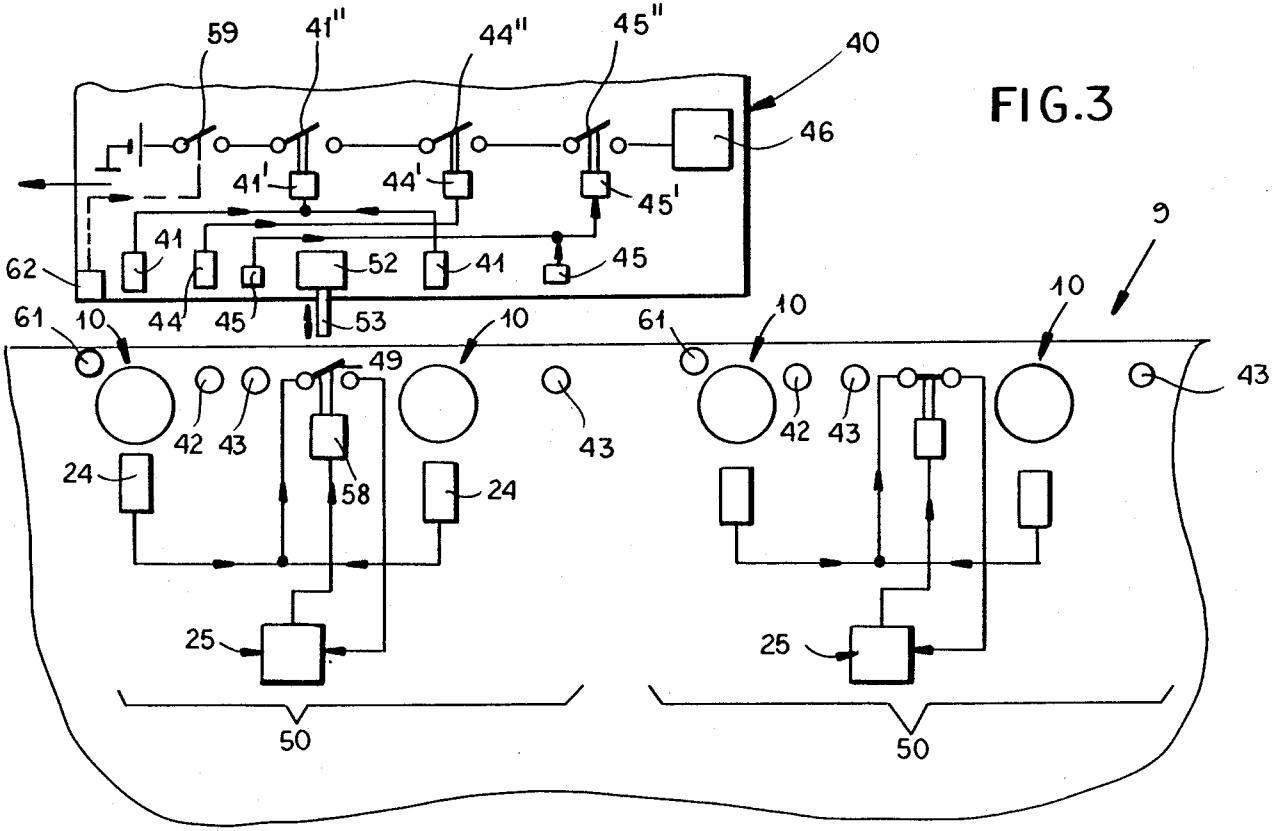

The spinning unit 10 of a ring spinning frame 9, represented in FIG. 1, which has a plurality of spinning units 10 of this kind arranged on both longitudinal sides of the machine, generally several hundred up to optionally thousand such spinning units, has a drawing frame 11 with a pair of feed rollers 12, a pair of intermediate rollers 13 and a pair of delivery rollers 14, which draw the roving 15 drawn-in by the feeding rollers 12. The drawn sliver is delivered by the delivery roller pair 14 and immediately twisted into a yarn 16 by the ring spinning device 17. Twisted yarn is then wound around a bobbin or sleeve 19 mounted on spindle 18. The spindle 18 penetrates a spinning ring 20, mounted on a ring rail 21 whereon a runner 22 is slidably supported. This runner entrains yarn 16 as the latter travels on its way from the yarn guide 23 to the driven spindle 18. Twist is imparted therethrough to the yarn 16.

When a yarn break occurs, runner 22 stops and a yarn-break sensor 24, located oppositely to the travel path of the runer and which for instance can operate inductively, senses the absence of the continuous running of the steel runner 22 and indicates that a yarn break has occurred. The signal is directed towards a stopping device 25.

Device 25 is commonly assigned to two neighboring spinning units, constituting a spinning units pair and can be activated through each of the yarn break sensors 24 of this spinning units couple for the simultaneous stopping of the feeding of both rovings 15 coming to this spinning units pair from the double-roving bobbin 26. These two rovings 15 are fed in common to each of the neighboring drawing frames 11 of a spinning units pair.

The stopping device 25 has two shells 29, extrending over slightly more than 180° of the circumference of the lower feed roller 27. These shells are firmly connected through a common connection bridge 30 and are supported by themselves on the lower feed roller 27. Upper rollers 31 press against the lower roller 27. These two feed roller pairs 12, consisting of the two upper rollers 31 and the lower roller 27. Simultaneously the two rovings is coming together from the common double-roving bobbin 26 are drawn in parallel into the two neighboring drawing frames 11, and then separately spun and wound into yarns 16.

A manually operatable handle 32 is provided on the connection bridge 30 of the two shells 29. Through handle 32 the stopping device 25 can be reset in its normal operating position after it has been activated, i.e. it has triggered the arrest of the roving 15, so that it does not hinder the run of the rovings 15. This can be done manually or can be performed automatically by a yarn-setting carriage 40.

However, when a yarn break occurs at anyone of the two spinning units 10 of the spinning units pair 50 which is supplied each with a roving 15 from the same bobbin 26, the respective yarn break sensor 24 senses this and excites an electromagnet 33 of the stopping device 25. An anchor 34 associated with electromagnet 33 holds the bridge 30 and thereby the shells 29 normally in the position shown in FIG. 1 as long as no yarn breaks exist at these two spinning units 10. In this normal position, the shells 29 have no influence on the rovings 15. This is due to the fact that the anchor 34 holds a pin 36 provided at the bridge 30 in the position shown in FIG. 1, wherein the two shells 29 are at a distance from the clamping line of the two feed roller pairs 12. If a yarn break occurs at any one of these two spinning units 10, the electromagnet 33 is excited and attacts its anchor 34 which releases the pin 36. Both shells 29 thereby become entrained by their friction with the rotating lower roller 27 in the direction of arrow A. These shells then reach the clamping line of the two feed roller pairs 12 of this spinning unit pair. The two upper rollers 31 are thereby lifted somewhat from the lower roller 27 which drives them, so that these upper rollers 31 are stopped. Shells 29 now clamp the two rovings 15 against the now arrested upper rollers 31, so that the rovings break between the upper rollers 31 and the intermediate roller pair 13, and, as a result, can no longer be drawn into the drawing frames 11. Thereby a sequel yarn break occurs in each of the other spinning unit 10 of the two spinning units 10 assigned to the same stopping device 25.

A yarn-setting carriage 40 runs along this spinning frame for the automatic detection and correction of yarn breaks. Carriage 40 has the equipment required for fixing yarn breaks, which equipment can be of the known type and does not need a closer description and therefore is not illustrated. This yarn-setting carriage 40 has two yarn break sensors 41, which sense occurrence of a yarn break at the two spinning units of any spinning units pair 50. These breaks are reached by the yarn-setting carriage 40. At the breakage point the yarn-setting carriage 40 stops under certain prerequisites which are described further, whereby it fixes first one yarn break and then continues to run so that its yarn-break correction equipment can also fix the other yarn break.

Instead of the two sensors 41, it can also be sufficient to have only one yarn break sensor at the yarn-setting carriage 40, since, as already mentioned, yarn breaks occur simultaneously at two neighboring spinning units assigned to the same stopping device.

Further, to each spinning units pair 50 a signal emitter 42 is assigned, which emits signals received by receiver 44 mounted on the carriage 40 at the arrival of the yarn-setting carriage at this spinning units pair, to indicate the presence of roving at both the spinning units 10 of this spinning units pair 50. This for instance, can be sensed with two photooptical sensors, which are arranged in front of the respective drawing frames 11 at the running path of the respective rovings.

When at both spinning units 10 the roving 15 is present, this fact is signalled by the signal emitter 42 to the receiver 44 mounted on the yarn-setting carriage 40, through non-contact signalling. As a result of this received signal, a switch 44″ is closed on the yarn-setting carriage through the receiver 44 via the positioning element 44′ controlled by the receiver. Each of the two yarn break sensors 41 on the yarn-setting carriage 40 can further close a switch 41″, via a common positioning member 41′ which is actuatable by each of the sensors, when it detects a yarn brreak at the spinning unit of the spinning unit pair 50 which has been assigned to it.

At each spinning unit 10 a signal emitter 43 is further provided. At the yarn-setting carriage 40, two receivers 45 are arranged at the same distance at which the signal emitters 43 of the individual spinning unit pair 50 are arranged with respect to each other. The signal emitter 43 sends signals to the receiver 45 of the yarn-setting carriage 40 arriving at the respective spinning units pair 50, advising whether one of the two spinning units 10 has been registered as "dead". This registration can be done, for instance, by upward folding of the yarn guide 23 via an actuation device 55 mounted on the yarn-setting carriage, whenever the yarn-setting carriage 40 has made a predetermined number of unsuccessful attempts directly following one another. The receiver 45 senses then at the arrival of the yarn-setting carriage whether the yarn guide 23 is turned upwardly or not. This can for instance be done by mounting a light-reflecting foil on the yarn guide 23, which reflects the light coming from an emitter mounted on the yarn-setting carriage to the receiver 45 only in the upward-folded position.

If none of the two receivers 45 detects the upward-folded position at the yarn guide of anyone of the two spinning units 10 of the spinning units pair 50, the receiver 45 initiates the closing of a switch 45″ via a positioning member 45′. The switches 41″, 44″, 45″ are normally open. In series therewith is a switch 59, which is shortly closed and then reopened, when the receiver 44, 45 arrives oppositely to the signal emitters 42, 43.

The yarn setter 40 stops only then for the correction of both yarn breaks at a spinning unit pair 50, when at the arrival of the yarn-setting carriage 40 at the respective spinning units pair 50, all four switches 59, 41″, 44″ and 45″ are closed. Thereby, the switch 41″ is closed by each of the two yarn break sensors 41 when it senses one yarn break, e.g. it senses photooptically the absence of the yarn between the respective drawing frame 11 and the yarn guide 23.

The switches 44'' and 45'', as mentioned, are always closed when at both spinning units the roving is present and neither one of the two spinning units is registered as a dead unit.

This way, there are two successful prerequisites for yarn break corrections at the respective spinning units pair 50, and the yarn-setting carriage 40 is stopped by a control device which is activated when it comes to the closing of all these switches 59, 41'', 44'', 45'', the control device being connected in series with these switches 41'', 44'', 45'', 59 which are also connected in series, which device then causes the yarn setter 40 to stop in predetermined positions at this spinning units pair and to correct first the one yarn break and then the other. If a yarn break can not be corrected after, for instance, three attempts, the respective spinning unit 10 or the respective spinning units pair 50 is registered as "dead" by turning upwardly the respective yarn guide 23 and the immediate continuation of the search run of the yarn-setting carriage 40 is resumed for the purpose of detection of further yarn breaks.

The assigned stopping device 25 is already activated with the occurence of the first yarn break at this spinning units pair 50 and the two rovings are arrested as an described. Each activation of the stopping device 25 has an immediate consequence the disconnection of the two yarn break sensors 24 through the stopping device 25, namely by opening a switch 49 via the positioning member 58 controlled by the stopping device 25.

This way, the yarn break correction at both spinning units 10 can not be disturbed by the yarn break sensors 24. Specifically, at the onset of the first yarn correction to be performed, the stopping device has again to be inactivated at this spinning units pair, so that it is alltogether possible to spin yarn again at these two spinning units 10. Thus, the yarn setter 40, after stopping at the respective spinning unit 10, first inactivates against the stopping device 25. Inactivation can take place, for instance, through means of a positioning member 56 mounted on the yarn-setting carriage 40 as shown in dottted lines in FIG. 1. Positioning member 56 may include a lifting magnet or a cylinder-piston unit or the like which activates a pressing rod 57 to turn a lever 32 in clockwise direction (arrow D), until a pin 36 snaps again into the position shown in FIG. 1, behind the anchor 34 of the electromagnet 33. At this point, the upper rollers 31 of this spinning units pair 50 come to lie against the lower rollers 27 and the two rovings 15 are once again continuously drawn into the drawing frame 11. There the rovings are drawn and leave the delivery roller pair 14 as drawn slivers, so that the yarn-setting carriage can correct the yarn breaks.

If the switch 49 would be connected before the yarn breaks have been fixed at this spinning units pair 50, then at least one of the two yarn break sensors 24 would immediately activate the stopping device 25. In order to avoid this, the switch 49 is closed only after both yarn breaks have been corrected, which takes place due to a positioning member 52 located at the yarn-setting carriage 40, which can move a striker 53 in the direction of the double arrow towards the switch 49 to close it and then again back towards the initial position. Immediately after that, the yarn-setting carriage 40 is restarted on its search run for yarn breaks.

The opening and closing of the switch 59 of the yarn-setting carriage 50 can for instance be performed through a sender or transmitter 61, mounted on the respective spinning units pair, which cooperates with a receiver 62 mounted on the yarn setter 40.

The registration of dead spinning units by upwardly folding the yarn guide can be replaced by other types of registration. The registration of the "dead" spinning units pair can, for instance, take place in a central data storage. In this arrangement the yarn setting carriage, at its arrival at the spinning units pair, checks the data storage in order to establish whether this spinning units pair has been registered as "dead" or not. Tbhis can be the case at each arrival at the respective spinning units pair or only at spinning units pairs with yarn breaks.

We claim:

1. Apparatus for spinning of yarns from rovings comprising:

a spinning frame;

a plurality of spinning units arranged on said frame wherein each two neighboring spinning units form a spinning units pair which is supplied with the roving to be drawn from a common double-roving bobbin;

a plurality of drawing means for drawing said rovings which means are also arranged on said frame and one of said drawing means is associated with each of said spinning units;

a yarn break sensor assigned to each of said spinning units; and stopping means for arresting and restarting feeding of said rovings simultaneously to both said drawing means of a spinning units pair, each of said stopping means including a pair of shells which press both rovings against a pair of upper rollers arresting said rollers.

2. Apparatus for spinning of yarns from rovings comprising:

a spinning frame;

a plurality of spinning units arranged on said frame wherein each two neighboring spinning units form a spinning units pair which is supplied with the roving to be drawn from a common double-roving bobbin;

a plurality of drawing means for drawing said rovings which means are also arranged on said frame and one of said drawing means is associated with each of said spinning units;

a yarn-spinning carriage for the automatic correction of yarn breaks; and a detecting means positioned on an element selected from the group consisting of said yarn-setting carriage, said spinning frame, and a combination thereof, which at the start of a first yarn-break correction attempt checks whether at each of the two spinning units there is present one or more prerequisites to achieve a successful yarn-breaking correction, and if said checking indicates said prerequisites are not met, said detecting means triggers said carriage to continue travelling without attempting said correction.

3. An apparatus according to claim 2 further comprising:

a yarn break sensor assigned to each of said spinning units of a spinning units pair;

stopping means for arresting and restarting feeding of said rovings simultaneously to both said drawing means, said stopping means assigned to each of said spinning units pair, and said stopping means being actuatable by each of said two yarn break sensors of a spinning units pair.

4. An apparatus according to claim 1 wherein a separate stopping means is assigned to each of the two spinning units of a spinning units pair.

5. An apparatus according to claim 2 wherein a separate stopping means is assigned to each of the two spinning units of a spinning units pair.

6. An apparatus according to claim 1 wherein the two spinning units of the spinning unit of each spinning units pair have a commonly assigned stopping means.

7. An apparatus according to claim 2 wherein the two spinning units of the spinning unit of each spinning units pair have a commonly assigned stopping means.

8. An apparatus according to claim 1 further comprising:

a yarn-setting carriage for the automatic correction of yarn breaks;

a detecting means positioned on an element selected from the group consisting of said yarn-setting carriage, said spinning frame, and a combination thereof, which at the start of a first yarn-break correction attempt checks whether at each of the two spinning units there is present one or more prerequisites to achieve a successful yarn-breaking correction, and if said checking indicated said prerequisites are not met, said detecting means triggers said carriage to continue travelling without attempting said correction.

9. Apparatus according to claim 2 wherein said detecting means senses a prerequisite condition selected from the group consisting of whether at both spinning units of the respective spinning units pair roving can be fed to the drawing frames of these two spinning units, whether in a ring spinning frame travelers are present on their spinning rings at both spinning units, whether predetermined drawing frame rollers of the drawing frames are free of yarn lappings, whether the respective spinning units pair is registered as "dead" or one of its spinning units is registered as "dead", and combinations thereof.

10. Apparatus according to claim 9 further comprising a slubbing-stop means to arrest the rovings, said slubbing-stop means being associated with each of a spinning units pair, and when the yarn-setting carriage unsuccessfully interrupts its yarn-break correction attempt at a first spinning unit of a spinning units pair and thereby triggers registration of the respective spinning units pair as "dead", said carriage does not perform a yarn-breaking correction attempt at the other spinning unit of this spinning units pair but instead triggers said slubbing-stop means.

11. Apparatus according to claim 1 wherein the stopping means assigned to the two spinning units of a spinning units pair are actuatable for the simultaneous stopping of both rovings.

12. Apparatus according to claim 2 wherein the stopping means assigned to the two spinning units of a spinning units pair are actuatable for the simultaneous stopping of both rovings.

13. Apparatus according to claim 1 further comprising:

a plurality of feed roller pairs associated with each spinning units pair comprising an upper and a lower feed roller;

stopping means including a pair of shells extending over more than 180° of the circumference of said lower feed roller; and a positioning means operating with an anchor, pin and electromagnet capable of holding said shells at a distance from said upper feed roller, wherein when a yarn break is sensed by said sensors at any one of the two spinning units, both of said shells become entrained by friction with the lower feed roller thereby lifting and arresting the upper roller, and said shells clamping of the two rovings against the now arrested upper roller so that said rovings break and are no longer being drawn into the drawings means.

14. Apparatus according to claim 2 further comprising a stopping means for arresting and restarting feeding of said roving simultaneously to both said drawing means, said one of said stopping means assigned to each of said spinning units pair, and each of said stopping means including a pair of shells which press both rovings against a pair of upper rollers arresting said rollers.

* * * * *